US007028490B2

(12) United States Patent
Tomlinson

(10) Patent No.: US 7,028,490 B2
(45) Date of Patent: Apr. 18, 2006

(54) WATER-HEATING DEHUMIDIFIER

(75) Inventor: John J. Tomlinson, Knoxville, TN (US)

(73) Assignee: UT-Batelle, LLC, Oak Ridge, TN (US)

( * ) Notice: Subject to any disclaimer, the term of this patent is extended or adjusted under 35 U.S.C. 154(b) by 0 days.

(21) Appl. No.: 10/856,521

(22) Filed: May 28, 2004

(65) Prior Publication Data

US 2006/0032244 A1 Feb. 16, 2006

(51) Int. Cl.
*F25B 27/00* (2006.01)

(52) U.S. Cl. ..... 62/115; 62/238.6; 62/505

(58) Field of Classification Search ..... 62/238.6, 62/285–291, 506
See application file for complete search history.

(56) References Cited

U.S. PATENT DOCUMENTS 4,513,585 A * 4/1985 Maisonneuve ..... 62/238.6
4,557,116 A * 12/1985 Kittler ..... 62/238.6
4,787,444 A * 11/1988 Countryman ..... 165/48.2
4,823,557 A * 4/1989 Bottum et al. ..... 62/238.6
5,979,172 A * 11/1999 Teller ..... 62/305
6,123,147 A * 9/2000 Pittman ..... 165/228
6,751,972 B1 * 6/2004 Jungwirth ..... 62/238.6

* cited by examiner

*Primary Examiner*—William E. Tapolcai
(74) *Attorney, Agent, or Firm*—Akerman Senterfitt

(57) ABSTRACT

A water-heating dehumidifier includes a refrigerant loop including a compressor, at least one condenser, an expansion device and an evaporator including an evaporator fan. The condenser includes a water inlet and a water outlet for flowing water therethrough or proximate thereto, or is affixed to the tank or immersed into the tank to effect water heating without flowing water. The immersed condenser design includes a self-insulated capillary tube expansion device for simplicity and high efficiency. In a water heating mode air is drawn by the evaporator fan across the evaporator to produce cooled and dehumidified air and heat taken from the air is absorbed by the refrigerant at the evaporator and is pumped to the condenser, where water is heated. When the tank of water heater is full of hot water or a humidistat set point is reached, the water-heating dehumidifier can switch to run as a dehumidifier.

7 Claims, 7 Drawing Sheets

WATER-HEATING DEHUMIDIFIER

STATEMENT REGARDING FEDERALLY SPONSORED RESEARCH OR DEVELOPMENT

The United States Government has rights in this invention pursuant to Contract No. DE-AC05-00OR22725 between The United Stares Department of Energy and UT-Battelle, LLC.

CROSS-REFERENCE TO RELATED APPLICATIONS

Not applicable.

FIELD OF THE INVENTION

The invention is related to the field of dehumidifier systems, and more particularly, to a dehumidification system including a heat pump water heater.

BACKGROUND OF THE INVENTION

Conventional dehumidifiers use a vapor compression cycle consisting of a refrigerant loop including an evaporator, compressor, condenser and expansion device. As room air is drawn through the evaporator, it is cooled to its wet bulb temperature at which point moisture in the air is condensed and collected for later disposal or other use. The cool, dehumidified air then passes through the condenser coil where it is heated before reintroduction into the room.

SUMMARY OF THE INVENTION

A water-heating dehumidifier includes a refrigerant loop including a compressor, at least one condenser, an expansion device, and an evaporator including an evaporator fan. The condenser includes a water inlet and a water outlet for flowing water therethrough, or proximate thereto. In a water heating mode air is drawn by the evaporator fan across the evaporator to produce cooled and dehumidified air. Heat taken from the air is absorbed by the refrigerant at the evaporator and is pumped to the condenser, where water is heated. When the tank of water heater is full of hot water, the water-heating dehumidifier can switch to run as a conventional dehumidifier.

The condenser can comprise a duplex condenser having a first tube in fluid connection with the refrigerant loop and a second tube including the water inlet and water outlet for flowing water therethrough, where the first and second tube are thermally coupled. The duplex condenser can be a tube-in-tube condenser. In one embodiment, the duplex condenser can comprise an open cell matrix material, wherein the matrix material provides the thermal coupling between the and second tube. The matrix material can comprise a carbon foam, such as a metallic carbon foam or a graphitic foam. The carbon foam can provide a bulk thermal conductivity at 25° C. of at least 20 W/m•K, and preferably at least 50 W/m•K.

In an alternate embodiment, a first and second condenser both in fluid connection with the refrigerant loop is provided. The first condenser provides the water inlet and water outlet for flowing water therethrough or proximate thereto and the second condenser is an air-cooled condenser having a path for flowing the cooled and dehumidified air therethrough. The first condenser can be affixed to a surface of a water tank for heating the surface, the surface not being in physical contact with water in the tank. The surface can be a central vent pipe of a gas water heater. The surface being heated can include a bottom of the water tank of either a gas water heater, or an electric water heater.

In a second alternative embodiment, the first condenser comprises a linear, double-walled immersed condenser. In this embodiment, the immersed condenser can comprise a double-walled linear condenser in series with a self-insulated capillary tube expansion device. The expansion device prevents reheating of refrigerant in the refrigerant loop as it leaves the tank and enters the evaporator.

A system for dehumidifying air and heating water includes a refrigerant loop including a compressor, at least one condenser, an expansion device, and an evaporator including an evaporator fan. The condenser includes a water inlet and a water outlet for flowing water therethrough or proximate thereto, wherein in a water heating mode air is drawn by the evaporator fan across the evaporator to produce cooled and dehumidified air and heat taken from the air is absorbed by refrigerant at the evaporator and pumped to the condenser. The system also includes a water heater, and a water loop including a water pump, the water heater, the water inlet and the water outlet of the condenser. At least a portion of energy to heat the water is provided by the condenser in the water heating mode.

A method of heating water using a dehumidifier comprising the steps of pumping heat from air into a refrigerant fluid in a refrigerant loop to cool the air to its wet bulb temperature, wherein heated refrigerant and cooled and dehumidified air is produced. At least a portion of heat in the heated refrigerant is transferred to heat water. A first condenser can be used to produce the heated water and a second condenser can be used for heating the cooled and dehumidified air. The method can include the step of switching between the transferring step and the heating step, such as based on the temperature in the tank or a humidistat set point. The method can include the step of transferring heat from the heated water to heating air for space heating an enclosed volume.

BRIEF DESCRIPTION OF THE DRAWINGS

There is shown in the drawings embodiments which are presently preferred, it being understood, however, that the invention can be embodied in other forms without departing from the spirit or essential attributes thereof.

DETAILED DESCRIPTION OF THE INVENTION

The invention is a new appliance that employs a vapor compression cycle to dehumidify the air surrounding the appliance, while at the same time generating hot water for domestic use. Rather than heating the cooled, dehumidified air produced by the evaporator using a conventional air-cooled condenser before reintroduction into a room, heat from the cooled air is instead transferred to water to offset the need for energy to heat water for domestic uses. Thus, heat that is removed from the air to provide cooling and dehumidification is used to provide the energy that would otherwise be required in the form of either gas or electric in conventional hot water heaters. This maximizes the efficiency of both the dehumidification process as well as hot water production. By design, the invention can operate as a dedicated dehumidifier or in a combined mode in which dehumification and hot water production are accomplished simultaneously.

Figure 1:
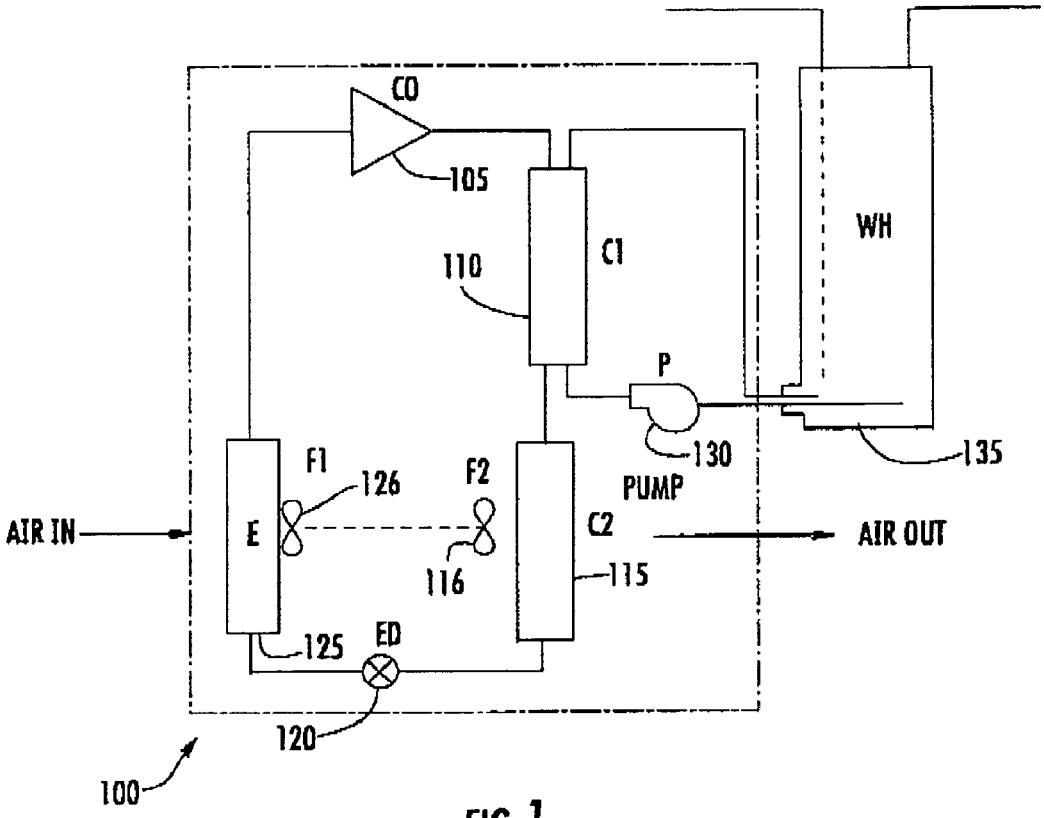
FIG. 1 is a schematic of a water-heating dehumidifier having a first condenser to heat water and a second air-cooled condenser to heat air, according to a first embodiment of the invention. In this embodiment, water is recirculated from the tank through the first condenser by a water pump.

FIG. 1 is a schematic of a water-heating dehumidifier 100 according to a first embodiment of the invention. Water-heating dehumidifier 100 includes a refrigerant loop which includes compressor 105, first condenser 110, second condenser 115, expansion device 120 and evaporator 125. Second condenser 115 includes an associated fan 116, while evaporator 125 includes an evaporator fan 126. An important feature of water-heating dehumidifier 100 is condenser 110 which functions in FIG. 1 as a water-cooled condenser. Inclusion of this "extra" condenser 110 enables water-heating dehumidifier 100 to operate under several different modes of operation.

In Mode 1, which is a water heating mode, room air is drawn in by fan 126 across evaporator 125 where it is cooled and dehumidified. Refrigerant is drawn through expansion device 120 by compressor 105, and heat absorbed by the refrigerant at evaporator 125 is rejected at condenser 110. In this mode of operation, pump 130 preferably recirculates water from the bottom of a conventional water heater 135 where it is the coolest, through the condenser 110. In this mode, fan 116 is not operating so that condenser 115 is inactive. As a result, the air (shown as AIRout in FIG. 1) leaving condenser 115 remains cool and dehumidified. Water-heating dehumidifier 100 preferably continues to operate in this mode as long as there is need for dehumidification as determined by a humidistat (not shown) and/or water heating as determined by the lower thermostat setting water heater 135.

Thus, when the tank of water heater 135 is full of hot water, the water-heating dehumidifier 100 can switch to run as a conventional dehumidifier. In Mode 2, pump 130 is off, and with no water circulating through it, and condenser 110 is inactive. Fan 116 is on activating air-cooled condenser 115 and AIRout is warm and dehumidified. Thus, in this mode water-heating dehumidifier 100 operates as a conventional dehumidifier and water heater 135 operates as a conventional water heater. When the lower thermostat setting water heater 135 is reached or a humidistat set point is reached, system 100 can switch back to Mode 1.

Dehumidifier-water heater 100 does not require the replacement of an existing, working water heater. The dehumidifier portion can generally be an add-on product easily adapted for installation with most water heaters.

A significant advantage of the invention relates to ease of installation. System 100 will generally be much the size of a domestic dehumidifier and will generally have a heating capacity of about 6,000 Btu/h or less. A single connection to the bottom of a water heater where the drain valve is generally located is all that is needed to hook up the hoses which permit water circulation between the humidifier portion of the invention and a conventional water heater. As noted above, dehumidifier-water heater 100 can be controlled by a humidistat as well as a temperature sensor on the fitting at the bottom of the water tank 135. By reducing the lower thermostat setting on the tank 135, the invention would assume most of the function of the lower heating element that conventionally provides well over 90% of all water heating.

Figure 2:
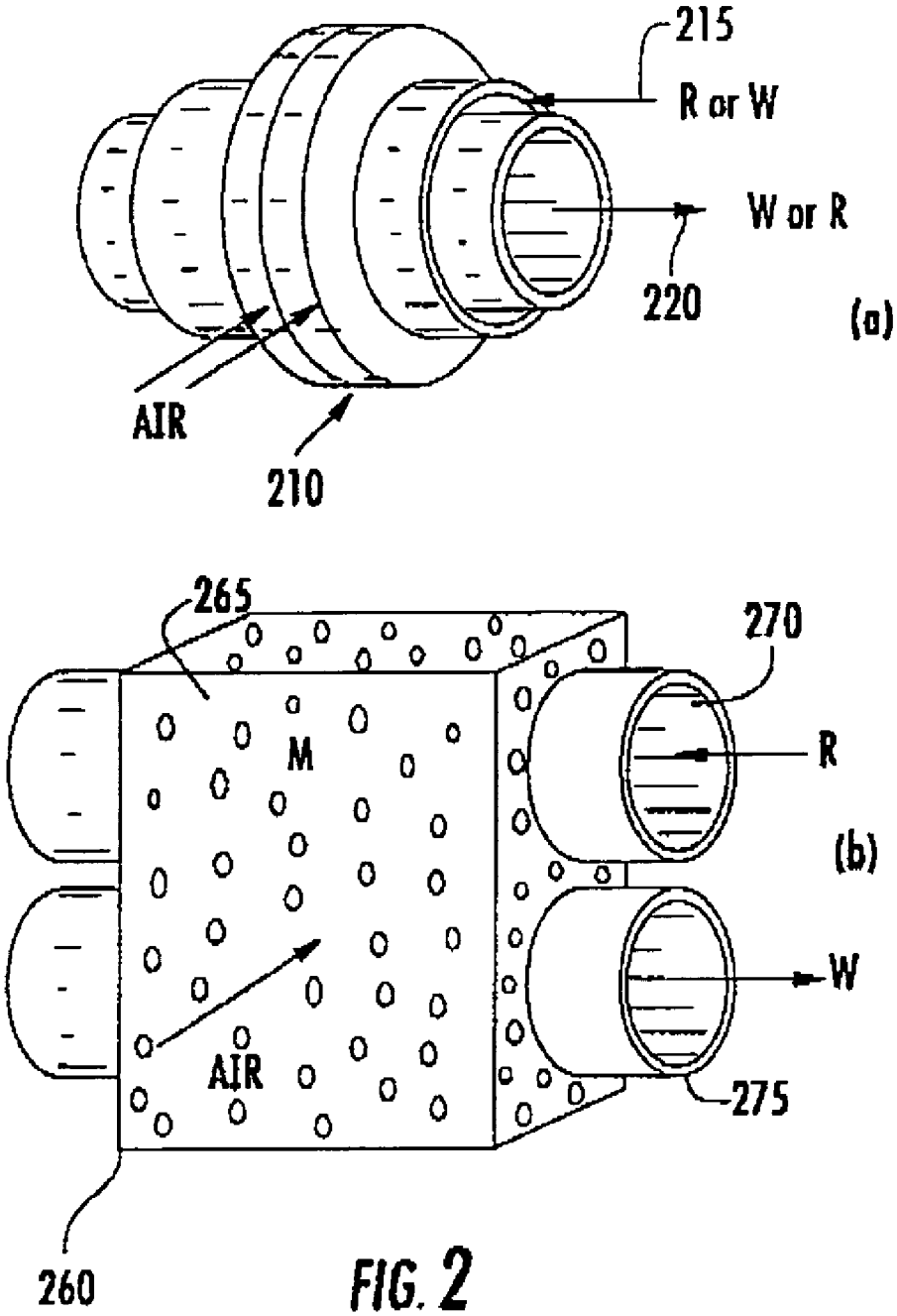
FIGS. 2(*a*) and (*b*) show exemplary duplex condenser designs, according to alternate embodiments of the invention. A single duplex condenser can be used to replace the two (2) condensers in the water-heating dehumidifier shown in FIG. 11*n* these embodiments, water is recirculated from the tank through the duplex condenser by a pump (not shown).

Another operating mode is possible, depending on the configuration of condensers 110 and 115. In a duplex condenser design, a single condenser that can be air- or water-cooled may substituted for the combination of condensers 110 and 115. A single duplex condenser is generally substantially more compact as compared to the combination of condensers 110 and 115. A second advantage of the duplex condenser embodiment is that hot water circulated from water heater 135 shown in FIG. 1 can also be used for space heating without operating compressor 105. This embodiment can be used to allow heat from the hot water to supplement the heat from a forced-air space heating system for a home FIGS. 2(*a*) and (*b*) show two exemplary duplex condenser designs according to embodiments of the invention. In these FIGS., R refers to refrigerant and W refers to water. In either embodiment shown, the refrigerant (R) can be condensed by using forced air as shown or by using water. FIG. 2(*a*) shows a tube-in-tube condenser 210 that uses water (W), or air. The annular region between the tubes 215 can carry water (W), or refrigerant (R), with the core region 220 carrying the other component. If refrigerant is carried in the annular region of the heat exchanger, it is always adjacent to the other two fluids (air and water), and can therefore deliver condenser heating efficiently to either fluid. If the refrigerant is carried in the core region, it can most efficiently heat the water carried in the annular region, and at a later time, the water circulated through the device can be used to heat the air. Therefore, the path for each component depends on the importance of an operating mode in which hot water is needed for supplemental space heating with air.

FIG. 2(*b*) shows a second exemplary duplex condenser 260. Condenser 260 includes an open-cell matrix 265 formed from a material having a high bulk thermal conductivity, such as at least 20 W/m•K at 25° C., and more preferably at least 50 W/m•K at 25° C. A first tube 270 and second tube 275 are formed in and extend through matrix 265. One of the tubes is used to carry water (275 in FIG. 2(*b*)), and the other tube (270 in FIG. 2(*b*)) is used for carrying the refrigerant. A porous metallic carbon foam or graphite foam material can be used for matrix 265 so that good convective and conductive heat transfer exists between tubes 265 and 270 carrying the condensing refrigerant and water, and the forced air through matrix 265 as shown in FIG. 2(*b*).

Figure 3:
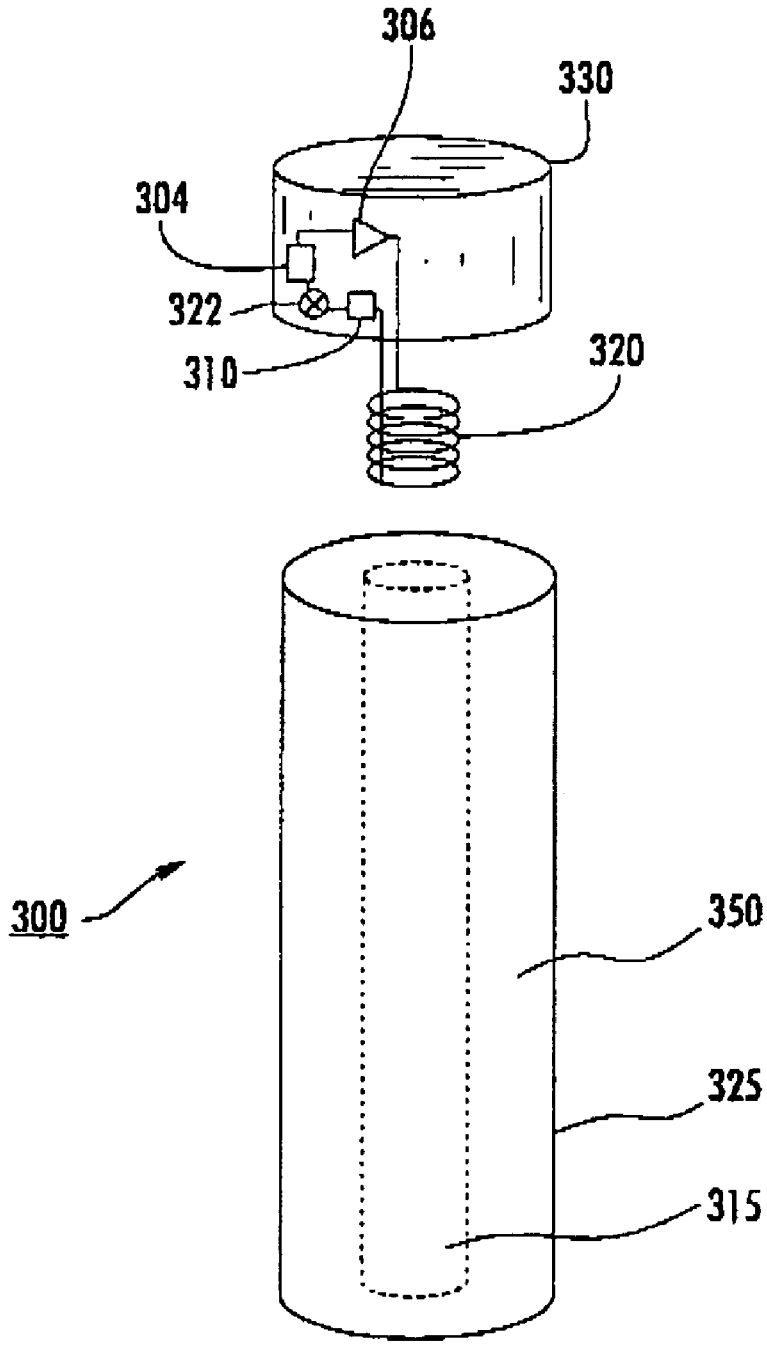
FIG. 3 is a schematic of a water-heating dehumidifier having the condenser as part of the water tank so that no pump is required, according to an alternate embodiment of the invention. Such a design allows a gas water heater tank with its burner removed to be used as part of the water-heating dehumidifier. Water is heated in the tank via thermal contact between a condenser inside the tank and the inner portion of the tank wall.

Another water heating dehumidifier system embodiment of the invention 300 is shown in FIG. 3. In this embodiment, unlike water-heating dehumidifier 100 shown in FIG. 1, no water is circulated from the water storage tank 325 and thus no water pump is required. A cylindrical housing 330 having a helical extension emerging therefrom at the top of system 300 includes the refrigeration components comprising evaporator 304, compressor 306, helical condenser 320, condenser 310, and expansion valve 322. Condenser 310 is an air cooled condenser, while condenser 320 is for heating water, being disposed in the volume containing water 350.

Cylindrical housing 330 is shown separated from water tank 325 for viewing ease only. Water tank includes central vent tube 315. In normal operation, cylindrical housing 330 rests on the top of tank 325 so that condenser 320 extends into the tank 325 within vent tube 315 and cylindrical housing 330 is sealed to the top of tank 325. Thus, since condenser 320 is applied to a surface external to the water in tank 325, the need for a double-wall condenser is eliminated since condenser 320 is not in the water during operation.

Although condenser 320 is immersed into the storage tank as shown in FIG. 3, condenser 320 can instead be wrapped around the storage tank (not shown). The central vent tube approach shown in FIG. 3 may be especially useful and provide an easy retrofit for most gas water heaters because conventional gas water heater tanks include a 3 to 4 inch central vent pipe along the axis that is open at the bottom for the gas burner and at the top to connect to the flue. Steel tanks with the central vent open at each end are manufactured as one welded component by gas water heater manufacturers.

Thus, water-heating dehumidifier 300 can be applied to existing water tank designs. Cylindrical housing 330 including helix condenser 320 can be inserted into the tank's 4-in central vent with a little room so that the helix 320 can slide in. Although shown in FIG. 3 as being short relative to the length of central vent tube 315, the length of helix condenser 320 can be as long as the entire length of the central vent tube 315. A fixture, either temporary or permanent can be inserted in the middle of the helix to press the condenser 320 against the inner wall of the vent 315 to improve thermal contact between the condenser 320 and vent tube 315 if desired. Thermal mastic can be used for this purpose. Following assembly, any remaining void space inside the central vent 315 can be thermally insulated, such as using a foam, to prevent heat losses moving up the central vent 315.

Figure 4A:
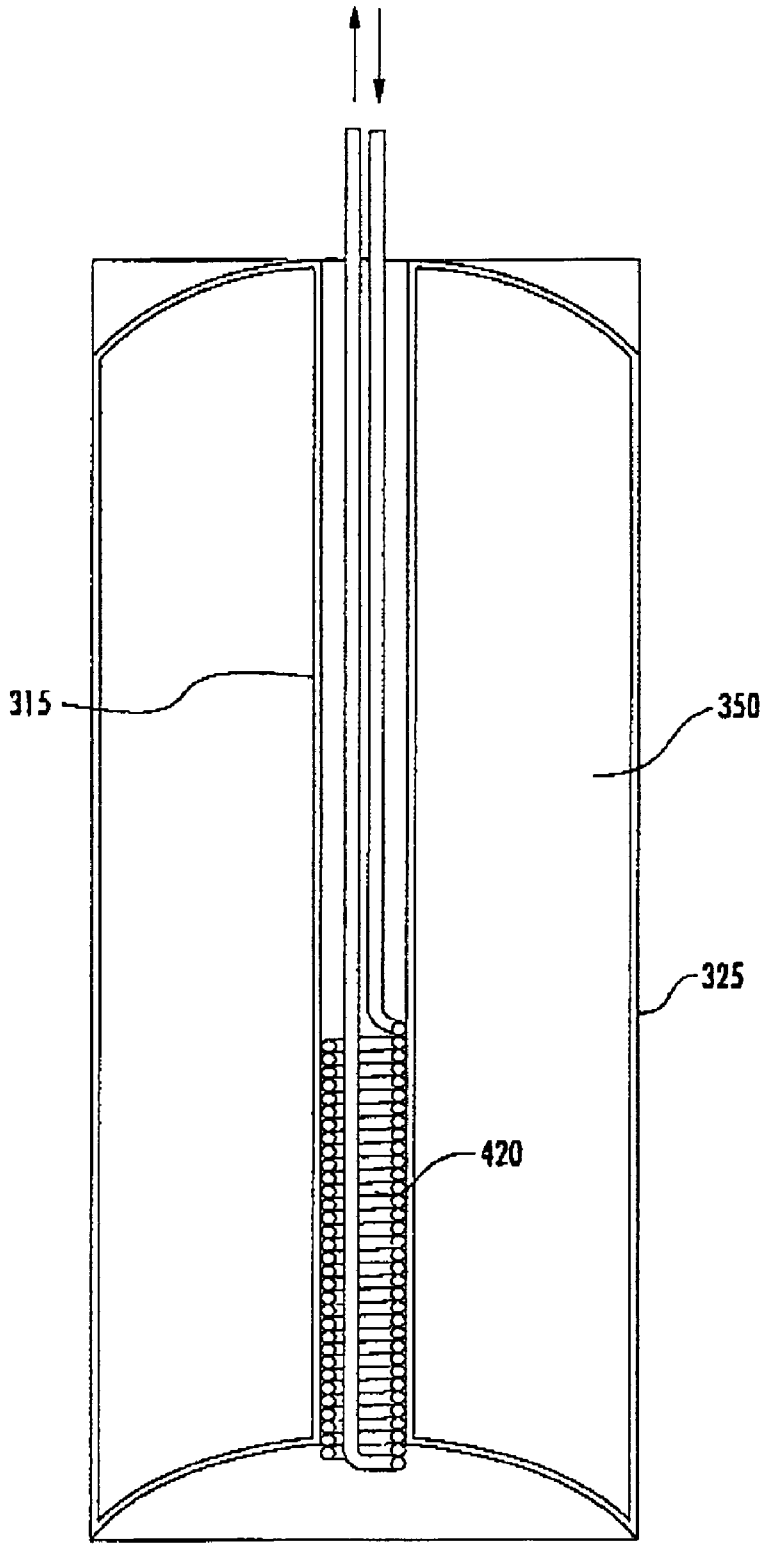
FIGS. 4(*a*) and 4(*b*) show alternative condenser designs for the water-heating dehumidifier shown in FIG. 3. These exemplary designs allow a gas water heater tank to be adapted and used in the design of a water-heating dehumidifier.
Figure 4B:
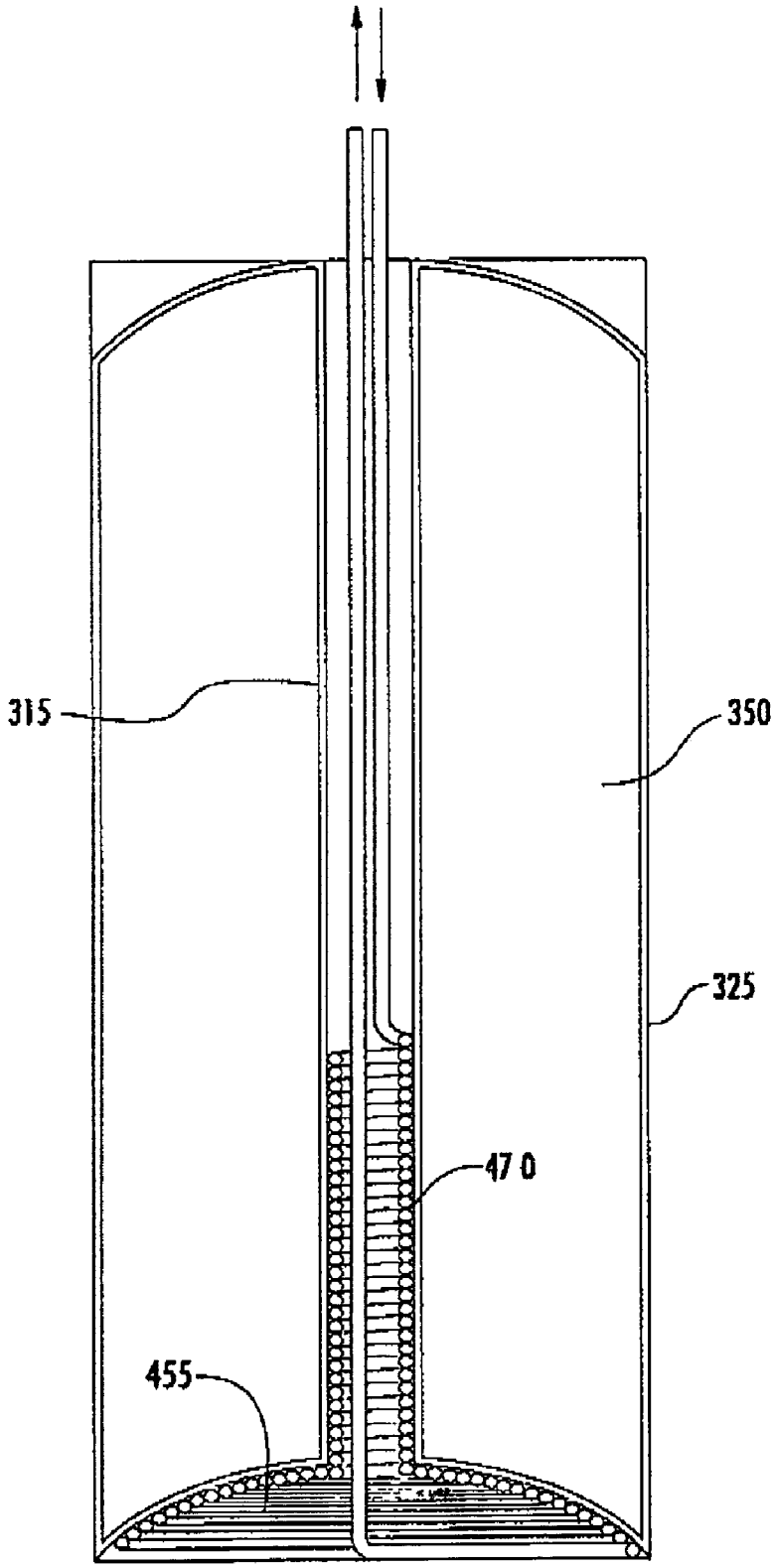

Condenser 320 can be provided in a variety of shapes other than the helical shape shown in FIG. 3 that can also easily adaptable to gas water heater tanks in which the burner has been removed. FIG. 4(*a*) shows a cross-sectional view of a condenser coil 420 showing added detail beyond the detail provided by condenser 320 shown in FIG. 3. Condenser 420 is inserted into the central vent pipe 315 of a gas water heater tank 325. The condenser coil 420 pressed against the central vent pipe 315 transfers heat into the water in volume 350 by conduction through the vent pipe 315 and convection into the water in volume 350. Improved thermal contact between the condenser coil 420 and vent pipe 315 can be provided with the help of a highly thermally conductive intermediate material, such as conventional heat transfer mastic.

Condenser 420 is shown disposed near the bottom of the central vent 315 as shown in FIG. 4(*a*). Arrows show the direction of refrigerant flowing in an out of tank 325 to condenser 420. Refrigerant enters at the top of the condenser 420 and exits at its bottom where the water in volume 350 of tank 325 is coolest. This maintains sufficient refrigerant subcooling for good performance. The design shown in FIG. 4(*a*) also provides double-walled protection between the refrigerant and the potable water being heated in volume 350.

Another alternative condenser coil design that uses a modified gas water heater tank is shown in FIG. 4(*b*). In FIG. 4(*b*), condenser 470 shown includes additional condenser surface area 455 provided by extending the condenser to cover some or all of the convex surface at the bottom of the water heater tank 325 where the entering water to the tank is always the coolest. This reduces the temperature difference between the condensing refrigerant in condenser 470 and the water in volume 350, provide greater refrigerant subcooling at the exit of the condenser 470 and as a result improved thermodynamic efficiency. Due to the wide footprint of surface area 455 relative to central vent 315, condenser 470 must generally be inserted from the bottom of tank 325 during installation.

Figure 5:
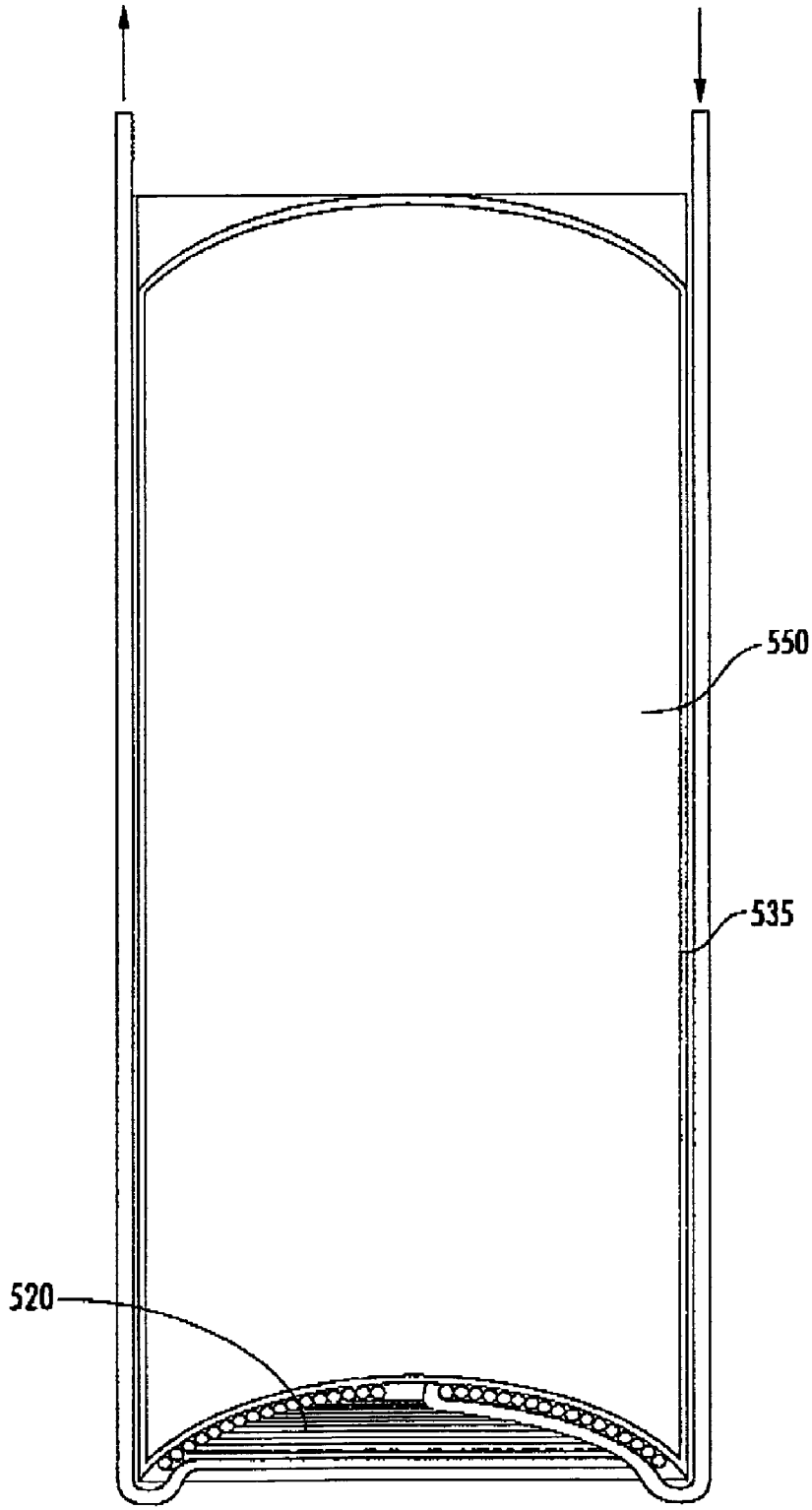
FIG. 5 shows an alternative condenser design for the water-heating dehumidifier shown in FIG. 1 which can be used to eliminate the need for a water pump. This design embodiment allows an electric water heater tank or conventional tank to be used for water-heating dehumidifiers according to the invention.

An alternative condenser 520 that can be used with a conventional electric water heating tank (no central vent) is shown in FIG. 5. This condenser design can replace condenser 110 and be used to eliminate the need for water pump 130 shown in FIG. 1. A coiled condenser 520 is pressed against the bottom of the water tank 535 to provide water heating. The condenser inlet and exit are along the outside of the tank 535. In a preferred embodiment, the inlet and exit of condenser 520 are inside the insulation (not shown) of the tank 535. Arrows show the direction of refrigerant flowing in an out of tank 535 to condenser 520. Water in volume 550 is heated from the bottom to maintain low condensing temperatures and therefore efficient performance.

Figure 6:
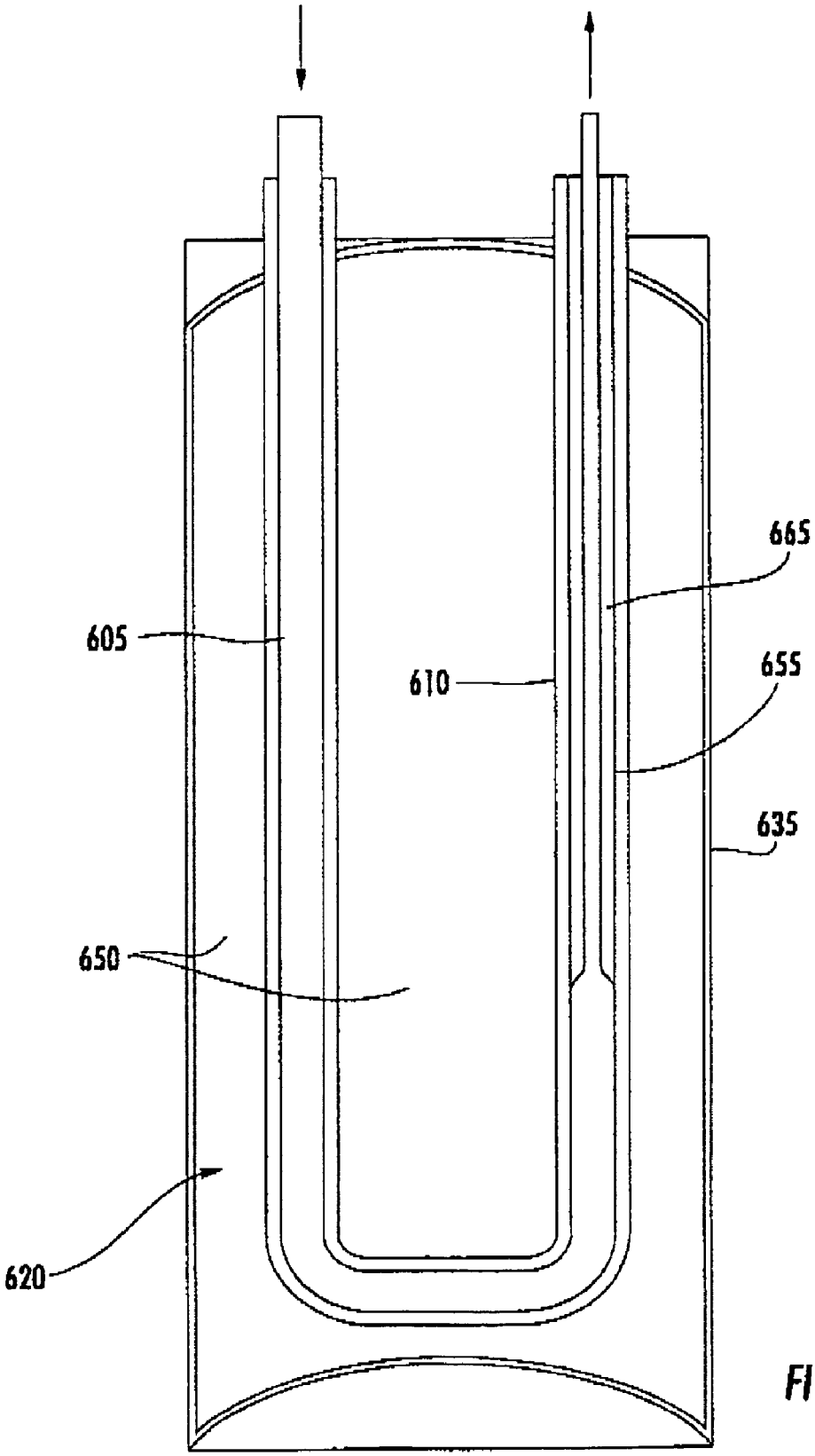
FIG. 6 shows an alternative design for the condenser and refrigerant expansion device used for the water-heating dehumidifier shown in FIG. 3. This alternative design is disposed inside the water tank and immersed in the water therein that is heated.

Another embodiment of the invention is the immersed condenser 620 shown in FIG. 6. Although one circuit is shown, multiple circuits are possible. Since the condenser 620 is immersed in the water, double-wall protection is needed and is provided by two tubes comprising inner tube 605 and outer tube 610, such as copper tubes. Should a refrigerant leak develop, the refrigerant will leak between the tubes 605 and 610 and exit at the top of the water heater 635. In operation, high pressure, hot refrigerant vapor from the compressor (not shown) enters the immersed condenser 620 at the top of FIG. 6. As the refrigerant flows downward, it condenses and transfers its heat of condensation to the water in volume 650.

To prevent reheating of the refrigerant as it passes up through the hot water at the upward leg of the condenser 620, inner tube 605 is narrowed significantly, such as terminating into a capillary tube 655 shown in FIG. 6 which functions as an expansion device. The capillary tube 655 shown on the upward leg of condenser 655 drops the temperature and pressure of the refrigerant. Heat transfer from the hot water in volume 650 of tank to the capillary tube 655 is greatly reduced due to the air space 665 disposed between the outer condenser tube 610 and the inner capillary tube 655. The refrigerant leaving the capillary tube passes to the evaporator (not shown) as is convention for a vapor compression cycle.

Although not shown, controls are generally included with water-heating dehumidifiers according to the invention, such as inside a suitable housing. Grilles or other flow pathways for moving air through the housing has also not been shown, but should be provided.

An important feature systems according the invention is manufacturing simplicity. For example, applied to both electric and gas water heaters, water-heating dehumidifiers according to the invention can generally utilize conventional water heater tanks that are already insulated and produced by the millions at very low cost.

The invention thus provides significant thermal efficiency by using a vapor compression cycle to move heat, rather than to generate heat. Conventional electric water heaters are likely about as efficient as they will ever be. With the addition of the invention to an electric water heater of the highest efficiency, the energy needed for water heating can be cut by an estimated 50%. This figure is based on recent field experience with a small domestic heat pump water heater of approximately the same capacity.

Mobile homes can also derive a special benefit from the invention with the addition of some additional ducting. The electric water heater in mobile homes is often located in a small closet next to an outside wall. Additional ducting could be added to allow a dehumidifier-water heater according to the invention to be installed, either by retrofit of an existing water heater or installation of a new dehumidifier-water heater. The dehumidifier-water heater can recirculate air in the mobile home in the summer and use Mode 1 to deliver cool dehumidified air to the home, and then use outside air in Mode 2 during the cooler winter months. Although the wintertime dehumidification benefit is lost, dehumidification is normally not a significant issue in the winter.

This invention can be embodied in other forms without departing from the spirit or essential attributes thereof and, accordingly, reference should be had to the following claims rather than the foregoing specification as indicating the scope of the invention.

We claim:

1. A water-heating dehumidifier, comprising:

a gas water tank including a central vent pipe;

a refrigerant loop including a compressor, a first condenser and a second condenser both in fluid connection with said refrigerant loop, an expansion device and an evaporator including an evaporator fan, wherein in a water heating mode air is drawn by said evaporator fan across said evaporator to produce cooled and dehumidified air and heat taken from said air is absorbed by said refrigerant at said evaporator and pumped to said first condenser, said first condenser having a water inlet and a water outlet for flowing water therethrough or proximate thereto to heat said water, said second condenser being an air-cooled condenser having a path for flowing said cooled and dehumidified air therethrough, wherein said first condenser has single wall insulating tubing thereon and is affixed to said central vent pine, said insulating tubing together with said central vent pipe providing double wall protection for refrigerant-to-water heat exchange occurring in said water tank.

2. The water-heating dehumidifier of claim 1, wherein said first and second condenser are connected in a series connection, wherein a full flow of said refrigerant passes through both said first and second condenser.

3. The water-heating dehumidifier of claim 1, wherein said first condenser is affixed to said central vent pipe at a bottom portion of said gas water tank.

4. The water-heating dehumidifier of claim 1, wherein said evaporator consists of a single evaporator.

5. A method of heating water in gas hot water tanks using heat supplied from dehumidifiers, comprising the steps of:

providing a gas water tank including a central vent pipe and a dehumidifier comprising a refrigerant loop including a compressor, a first condenser and a second condenser both in fluid connection with said refrigerant loop, an expansion device and an evaporator;

placing said first condenser of said dehumidifier inside said central vent pipe, wherein in a water heating mode air is drawn by said evaporator fan across said evaporator to produce cooled and dehumidified air and heat taken from said air is absorbed by said refrigerant at said evaporator and pumped to said first condenser, said first condenser having a water inlet and a water outlet for flowing water therethrough or proximate thereto to heat said water, said second condenser being an air-cooled condenser having a path for flowing said cooled and dehumidified air therethrough.

6. The method of claim 5, wherein said first condenser has single wall insulating tubing thereon, said insulating tubing together with said central vent pipe providing double wall protection for refrigerant-to-water heat exchange occurring in said gas water tank.

7. The method of claim 5, wherein said first condenser comprises a helical condenser.

* * * * *